United States Patent [19]

Zimmermann

[11] Patent Number: 4,871,071

[45] Date of Patent: Oct. 3, 1989

[54] VENT OPENING SCORING IN CONTAINER LID

[75] Inventor: John Zimmermann, Scarborough, Canada

[73] Assignee: Paperboard Industries Corporation, Toronto, Canada

[21] Appl. No.: 308,198

[22] Filed: Feb. 9, 1989

[51] Int. Cl.[4] ..... B65D 5/54; B65D 5/64

[52] U.S. Cl. ..... 206/628; 206/620; 229/123.2; 229/125.35

[58] Field of Search ..... 229/125.35, 123.2, 123.3; 206/620, 628, 629, 634

[56] References Cited

U.S. PATENT DOCUMENTS

| | | | |
|---|---|---|---|
| 1,773,553 | 8/1930 | Taylor et al. | 229/123.3 |
| 3,244,356 | 4/1966 | Wolowicz et al. | 206/628 |
| 3,298,593 | 1/1967 | Stephenson | 206/628 |
| 3,550,835 | 12/1970 | Persson | 229/125.35 |
| 4,312,451 | 1/1982 | Forbes, Jr. | 206/628 |
| 4,351,473 | 9/1982 | Manizza | 229/125.35 |
| 4,531,668 | 7/1985 | Forbes, Jr. | 229/125.35 |
| 4,574,956 | 3/1986 | Kuchenbecker | 206/629 |

*Primary Examiner*—Gary Elkins

*Attorney, Agent, or Firm*—Fetherstonhaugh & Co.

[57] ABSTRACT

A paperboard lid having first and second weakened score lines formed in the upper and lower faces thereof respectively. The score lines extend obliquely across the lid at a corner to form a frangible corner panel. The first score line is located between the corner and the second score line. A third weakened score line extends inwardly from the corner to the second score line. The path of the first and third score lines intersect one another at an intersection point, one of the first and second score lines is a discontinuous score line and the other is a continuous score line. The discontinuous score line is interrupted closely adjacent the intersection point such that the first and third score lines do not overlap at the intersection point. The corner panel is severable from the remainder of the lid by depressing it to cause it to buckle inwardly upon itself along the third score line and simultaneously causing it to tear between the first and second score lines to form an opening between the corner panel and the remainder of the lid.

22 Claims, 4 Drawing Sheets

VENT OPENING SCORING IN CONTAINER LID

BACKGROUND OF THE INVENTION

This invention relates to cartons such as those used as containers for food in which the food can be heated or cooked in an oven.

Cartons which are used to store food or other items which must be heated before they are consumed are usually lined with a tough ovenable plastic liner which may be made from a polyester film or the like. This liner serves to make the paperboard waterproof so that it will not absorb fluids which are stored within the container. Because of the presence of this liner, however, considerable difficulty is experienced in attempting to tear the lid in order to open the tray.

In one prior corner construction, the continuous score line which is formed in the upper face of the lid is spaced inwardly from the side edges of the lid so that it is located inwardly of the flange which supports the lid and the weakened score line which is formed on the lower face is located inwardly from the score line of the upper face in a spaced parallel relationship thereto. In addition, the weakened score line which is formed on the lower face and which extends inwardly from the corner terminates short of the weakened score line which is formed on the upper face. It has been found that this structure is difficult to open because of the difficulty experienced in rupturing the tough film of plastics material which is applied to the inner face of the lid.

In another known structure, a pair of spaced parallel crease lines extend inwardly from the corner on both the upper face and the lower face to form a tab. This tab forms an awkward obstruction which makes it difficult to pore liquid contents out of the vent passage which is formed by depressing the tab. In addition, difficulty is again experienced in attempting to rupture the plastic liner which is applied to the lower face of the lid because the weakened score lines do not extend to the inner weakened score line which is formed on the lower face.

It is an object of the present invention to provide a simple arrangement of weakened score lines on the lid of a tray which will facilitate the tearing of the lid in order to vent and to open the container.

SUMMARY OF THE INVENTION

According to one aspect of the present invention, there is provided in a paperboard lid having first and second side edges which meet at a corner, an upper face and a lower face, the improvement of first and second weakened score lines formed in said upper and lower faces of said lid respectively, and extending obliquely across the lid at said corner to form a tangible corner panel, said first score line being located between the corner and the second score line, a third weakened score line extending inwardly from the corner to the second score line, the path of the first and third score lines intersecting one another at intersection point, one of the first and second score lines being a discontinuous score line and the other being a continuous score line, the discontinuous score line being interrupted closely adjacent the intersection point such that the first and third score lines do not overlap at the intersection point, said corner panel being severable from the remainder of the lid by depressing the corner panel to cause it to buckle inwardly upon itself along the third score line and simultaneously causing it to tear between the first and second score lines to form an opening between the corner panel and the remainder of the lid.

According to a further aspect of the present invention, there is provided in a paperboard container of the type which comprises a tray which has upstanding side walls and a lid hingedly attached to one of the side walls, the remainder of the side walls having a flange projecting laterally outwardly from their upper edge, the lid having a marginal edge portion arranged to overlie the flange and to be attached thereto to close the container, the lid having an inner face and an outer face and side edges which meet at a corner of the container remote from the side wall to which the lid is attached, the improvement of first and second weakened score lines formed in said upper and lower faces of said lid respectively, and extending obliquely across the lid at said corner to form a frangible corner panel, said first score line being located between the corner and the second score line, a third weakened score line extending inwardly from the corner to the second score line, the path of the first and third score lines intersecting one another at intersection point, one of the first and second score lines being a discontinuous score line and the other being a continuous score line, the discontinuous score line being interrupted closely adjacent the intersection point such that the first and third score lines do not overlap at the intersection point, said corner panel being severable from the remainder of the lid by depressing the corner panel to cause it to buckle inwardly upon itself along the third score line and simultaneously causing it to tear between the first and second score lines to form an opening between the corner panel and the remainder of the lid.

The invention will be more clearly understood after reference to the following detailed specification read in conjunction with the drawings.

BRIEF DESCRIPTION OF THE DRAWINGS

With reference to FIG. 2 of the drawings, it will be seen that in the corner construction of the prior art may have a first continuous score line 12 is formed in the upper face of the lid and a second score line 18 is formed on the lower face of the lid in a spaced parallel relationship. The weakened score line 12 is a continuous line as is the weakened score line 18. The score line 18 is shown in broken lines merely to indicate that it is applied to the lower face and not to indicate that it is intermittent. Similarly, a third and fourth continuous score lines 21 are formed in the lower face and extend continuously to and terminate at the first score line 12. The third and fourth score lines 21 do not extend to the second score line 18. Fifth and sixth score lines 11 are formed in the upper face of the lid in a spaced parallel relationship and serve to form a tab 23 therebetween. The score lines 11 each terminate at the score line 12.

Figure 2:
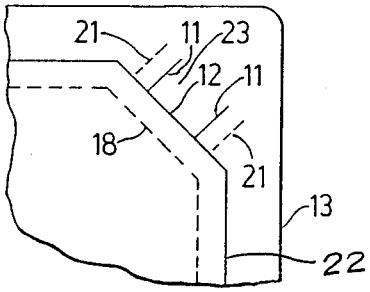
FIG. 2 (PRIOR ART)
FIG. 2 is a partially sectioned pictorial view of a corner portion of a carton constructed in accordance with a further example of the prior art.
Figure 6:
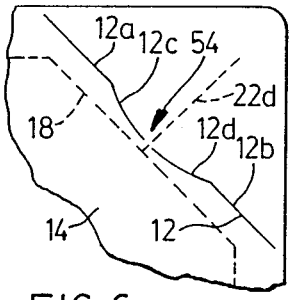
FIGS. 6 to 12 illustrate different score patterns which serve to provide corner constructions according to further embodiments of the present invention.
Figure 7:
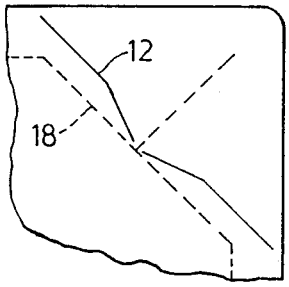
Figure 8:
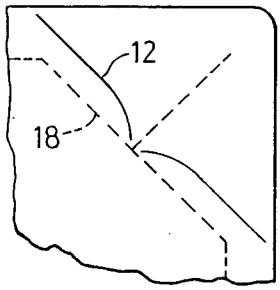
Figure 9:
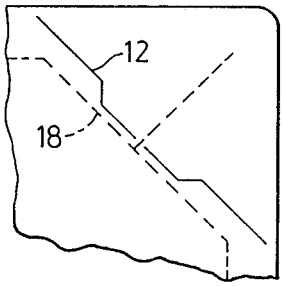

In order to open the prior art corner of FIG. 2, the corner tab 23 is manually depressed and this causes the paperboard to tear along the plane which extends from the tear line 12 to the second tear line 18 and from the tear lines 11 to the tear lines 21. The inner face 20 of the lid is lined with a tough film of plastics material and difficulty has been experienced in attempting to tear through this film in order to break the corner panel along the edge which extends along the score line 18. As a result, it is frequently necessary to use a knife in order to obtain an opening which will remain open rather than tend to become resealed. In addition, the tab 23 forms an obstruction which makes it difficult to pour liquid out of the container through the opening which is formed by depressing the tab 23.

In the embodiment of the prior art illustrated in FIG. 2 of the drawings, it will be seen that in the corner construction of the prior art may have a first continuous score line 12 is formed in the upper face of the lid and a second score line 18 is formed on the lower face of the lid in a spaced parallel relationship. The weakened score line 12 is a continuous line as is the weakened score line 18. The score line 18 is shown in broken lines merely to indicate that it is applied to the lower face and not to indicate that it is intermittent. Similarly, third and fourth continuous score lines 21 are formed in the lower face and extend continuously to and terminates at the first score line 12. The third and fourth score lines 21 do not extend to the second score line 18. Fifth and sixth score lines 11 are formed in the upper face of the lid in a spaced parallel relationship and serve to form a tab 23 therebetween. The score lines 11 each terminate at the score line 22.

In order to open the prior art corner of FIG. 2 the corner tab 23 is manually depressed and this causes the paperboard to tear along the plane which extends from the tear line 12 to the second tear line 18 and from the tear lines 11 to the tear lines 21. The inner face 20 of the lid is lined with a tough film of plastics material and difficulty has been experienced in attempting to tear through this film in order to break the corner panel along the edge which extends along the score line 18. As a result, it is frequently necessary to use a knife in order to obtain an opening which will remain open rather than tend to become resealed. In addition the tab 23 forms an obstruction which makes it difficult to pour liquid out of the container through the opening which is formed by depressing the tab 23.

Figure 1:
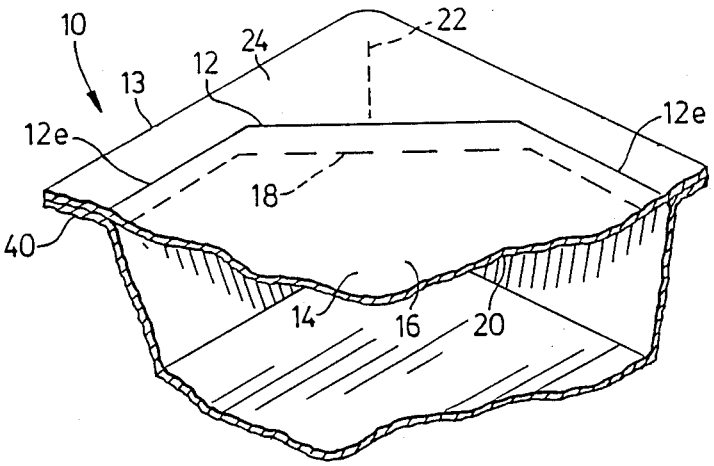
FIG. 1 (PRIOR ART)
FIG. 1*a* is a partially sectioned pictorial view of a corner portion of a carton constructed in accordance with the prior art.
FIG. 1*b* is a view similar to FIG. 1 illustrating a corner construction according to a further prior art structure.
Figure 3:
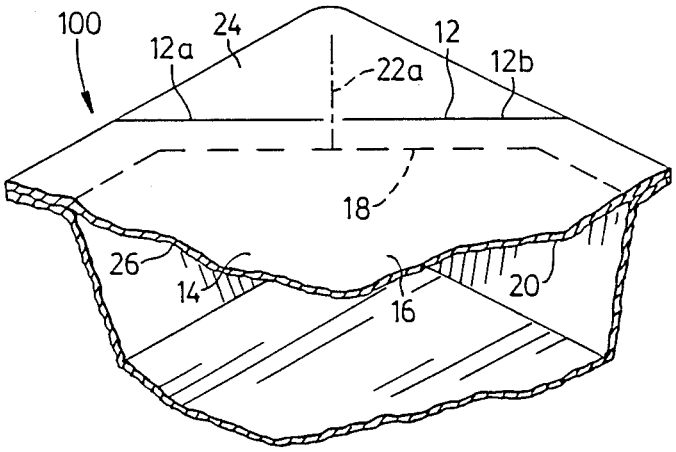
FIG. 3 is a view similar to FIG. 1 which illustrates the different pattern of score lines employed to form the frangible corner of the present invention.

As shown in FIG. 3 of the drawings in which like reference numerals have been applied to like parts and features, the corner construction 100 of the present invention is distinguished from that of the prior art in that the third score line which is identified by reference numeral **22*a* extends to the second score line and the first score line is a discontinuous score line consisting of score lines 12*a* and 12*b* which terminate one on either side of the third score line 22*a*** in close proximity thereto such that the first score line does not overlap the third score line.

As a result of this construction, a continous T-shaped score pattern is formed on the lower face 20 which extends through the tough plastic layer 26. As a result, when pressure is applied to the corner panel 24, it is not necessary to rely on this pressure in order to break or tear the tough plastics film which is applied to the lower face and consequently, the corner panel 24 can be easily depressed in order to provide an opening because the only resistance to tearing is the resistance of the fibres of the paperboard.

A blank suitable for use in the construction of the carton of the present invention is illustrated in FIG. 3 of the drawings which provides a view of the lower face 20 of the lid 16 to which the film 26 of a plastics material such as an ovenable polyester has been applied. The term "ovenable" is the term used in the industry to define a food grade plastics material which can withstand the cooking temperatures normally experienced in a conventional or microwave oven.

The blank 30 comprises a bottom wall panel 32 which has oppositely disposed side walls 34 and oppositely disposed end walls 36 hingedly attached thereto. The side walls 34 and 36 are connected by corner gusset panels 38.

The side walls 36 and the preside wall 34 each have a flange panel 40 hingedly connected to their upper edge. The lid 16 is hingedly connected to the upper edge of the other side wall 34 along a hinge line 42. In addition to the score lines 18 and **22*a* which are formed on the lower face 16, score lines 44, 46, 48, 50 and 52 are formed on the lower face 16 and serve to define a detachable inner lid panel 16*a* which is surrounded by a marginal edge portion 54 which is secured to the flanges 40 in use. It will be noted that whereas the continuation 12*e* of the score line 12 is spaced inwardly from the side edge 13 of the lid so that it is inwardly from the flange 40 in the structure of the present invention illustrated in FIG. 3, the score lines 12*a* and 12*b* extend to the edge 13**.

Figure 4:
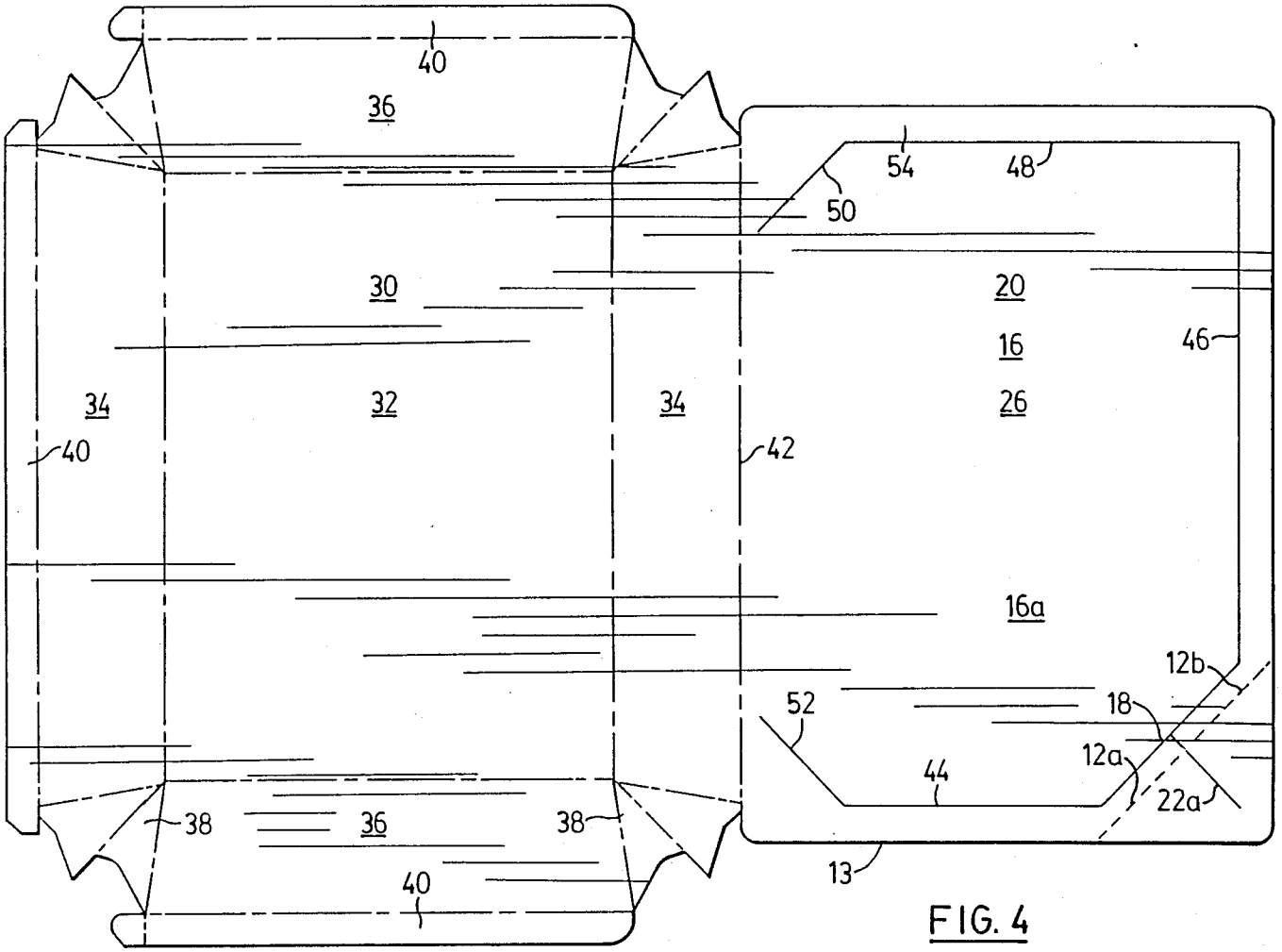
FIG. 4 is a plan view of a carton blank which can be assembled to provide the container of the present invention.

As shown in FIG. 4 of the drawings, the carton blank of FIG. 3 can be assembled to provide a tray portion 56. To open the lid, the corner panel 24 is depressed as previously described with reference to FIG. 2 and this causes the panel to buckle and partially tear along the third score line **22*a*. The same action causes the overlying portion 28 of the lid to tear along the portion of the third score line 22*a* which extends from the first score line 12 to the plane 18*a* of the second score line 18. The inner lid portion 16*a* can then be separated from the remainder of the lid by tearing the tear lines 44, 46, 48, 50 and 52 to the outer edge 13 to assume the open position shown in FIG. 4**. It will be noted that the adhesive which is used to secure the lid to the flange is preferably so strong that the lid will tear before the bond between the lid and the flange will give way.

The opening of the container can be carried out in two stages. In the first stage, the corner panel 24 is depressed in order to provide a vent opening between the corner panel 24 and the remainder of the lid 16. This may be the only opening that is necessary during the initial heating in order to permit the contents of the container to be vented. When the food is to be served, the opening of the lid can then be completed as previously described.

Figure 5:
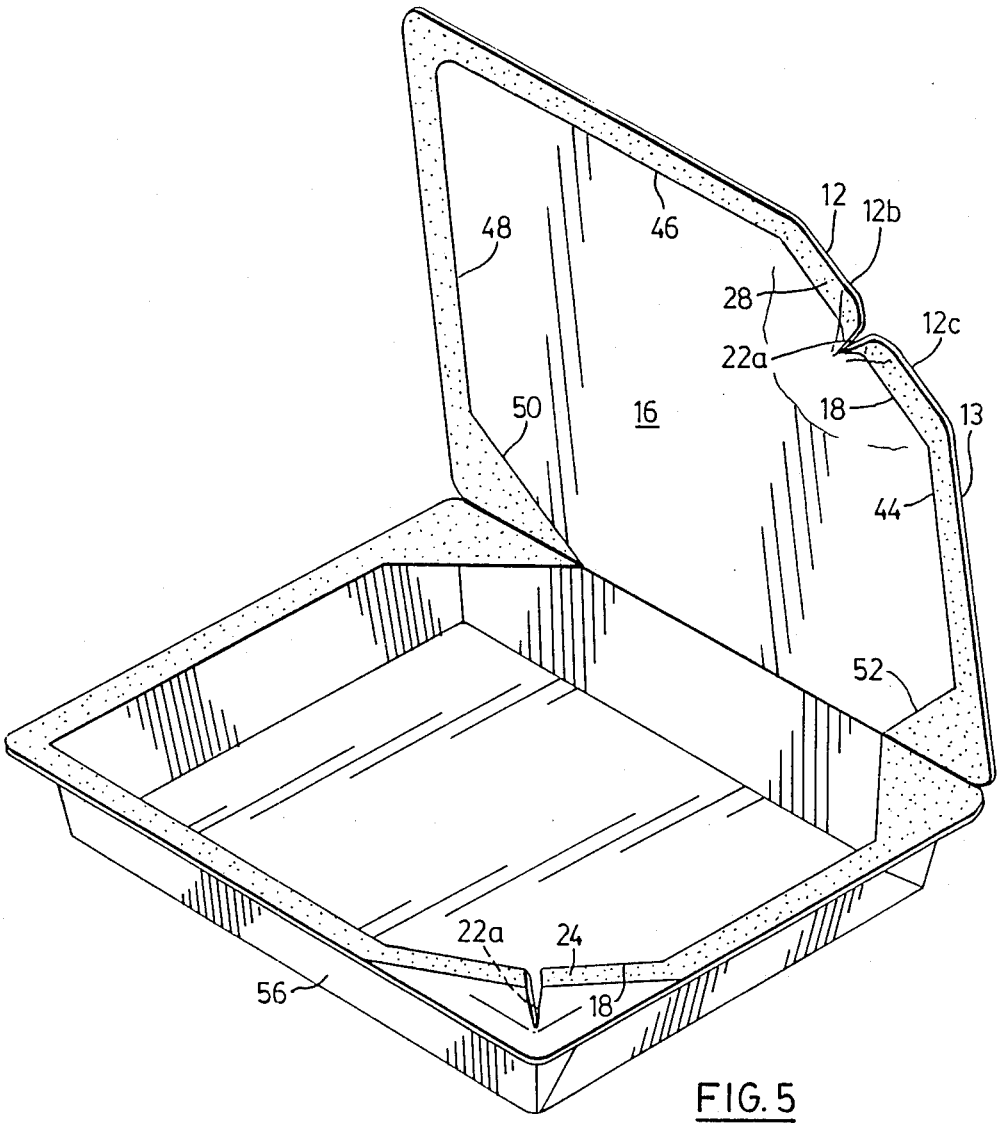
FIG. 5 is a pictorial view of a carton constructed in accordance with an embodiment of the present invention in which the lid is shown in the open position.

FIG. 5 illustrates a further embodiment of the present invention in which like numerals apply to like parts to those illustrated in FIG. 3. In this embodiment, the score lines 12 and **12*b* have portions 12*c* and 12*d* respectively, which converge toward the weakened score line 18 and toward one another to an intersection point 54 where the path of the score line 12 intersects the path of the score line 22*a*. It being understood that while the paths of the score lines 12 and 22*a* intersect one another, the score lines do not overlap at the point of intersection because the score line 12 is a discontinous score line which stops short of the intersection point 54. The intersection point 54 provides a rupture starting point and because it is located close to the second score line 18, this corner structure is easy to open because it is only necessary to tear through a short portion of the lid in order to form an opening which extends between the upper score line 12 and the lower score line 18**.

FIGS. 6, 7, 8, 9 and 10 show the various alternative forms which the score line 12 may follow in order to achieve the same result as that described with reference to FIG. 5.

Figure 10:
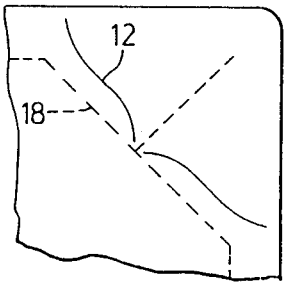

In FIG. 10, it will be noted that the score line **22*a* has been extended to project inwardly beyond the score line 18**. This structure may be used to provide for a larger opening.

Figure 11:
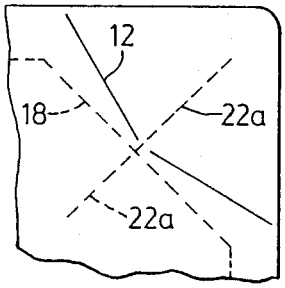
Figure 12:
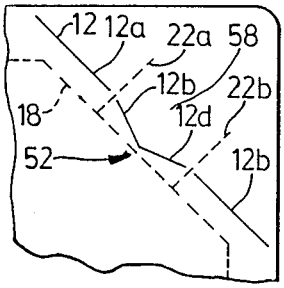

FIG. 11 illustrates a further embodiment in which a fourth score line **22*b* is formed on the lower face of the lid in a spaced parallel relationship with respect to the third score line 22*a*. In this stucture, the portions 12*c* and 12*d* of the score line 12 converge toward the score line 18 to form a rupture starting point 52. It will also be noted that while the path of the score lines 22*a* and 22*b* intersects the path of the score line 12, the score line 12 does not overlap the score lines 22*a* and 22*b*. A gap is formed between the portions 12*a* and 12*c* and between the portions 12*d* and 12*b* of the score line at the point where the paths intersect one another. To open the corner illustrated in FIG. 11, it is merely necessary to press down on the tab 58 which is formed between the score lines 22*a* and 22*b*. Again, because the score lines 12*c* and 12*d* extend to a point closely adjacent the score line 18 at the rupture starting point 52**, it is quite easy to apply a concentrated pressure to the rupture starting point which will rupture the plastic coating which is applied to the underside of the lid to facilitate the opening of the corner vent.

From the foregoing, it will be apparent that the present invention provides a simple and inexpensive corner construction which is easy to open.

Because the score line **22*a* does not overlap the score line 12*a*, 12*b***, the knives or rules which are used to form the score lines are not dulled by overlapping contact with one another. In addition, it is possible to penetrate the paperboard up to 50% of its thickness without completely cutting through the thickness of the paperboard at any point. These and other advantages of the construction of the present invention will be apparent to those skilled in the art.

Various modifications of this invention will be apparent to those skilled in the art. In one such modification, the lid and the container or tray may be formed as separate pieces which may be attached to one another by means of a heat sealing process or by an adhesive or the like.

I claim:

1. In a paperboard lid having first and second side edges which meet at a corner, an upper face and a lower face, the improvement of;

(a) first and second weakened score lines formed in said upper and lower faces of said lid respectively, and extending obliquely across the lid at said corner to form a frangible corner panel, said first score line being located between the corner and the second score line, (b) a third weakened score line extending inwardly from the corner to the second score line, (c) the path of the first and third score lines intersecting one another at an intersection point, one of the first and second score lines being a discontinuous score line and the other being a continuous score line, the discontinuous score line being interrupted closely adjacent the intersection point such that the first and third score lines do not overlap at the intersection point, (d) said corner panel being severable from the remainder of the lid by depressing the ,corner panel to cause it to buckle inwardly upon itself along the third score line and simultaneously causing it to tear between the first and second score lines to form an opening between the corner panel and the remainder of the lid.

2. A paperboard lid as claimed in claim 1, wherein the first score line is the discontinuous score line and the third score line is a continuous score line.

3. A paperboard lid as claimed in claim 1, wherein the first and second score lines converge toward a rupture starting point at which the spacing between the first and second score lines is such that the lid can be easily punctured by applying pressure to the starting point.

4. A paperboard lid as claimed in claim 1, wherein the first score line has portions of its length arranged one on either side of the intersection point which converge toward one another and toward the intersection point so as to be located in close proximity to the second score line at the intersection point.

5. A paperboard lid as claimed in claim 2, wherein the lower face of the lid is coated with a layer of ovenable plastics material, said second and third score lines being continuous and meeting one another such that the layer of plastics material is completely severed along the second and third score lines and the point at which he third score line meets the second score line such that the layer of plastic material does not offer any appreciable resistance to the tearing of the lid along the second and third score lines as the cover panel is depressed.

6. A paperboard lid as claimed in claim 5, wherein said weakened score lines do not extend through the paperboard lid.

7. A paperboard lid as claimed in claim 5, wherein the first and second weakened score lines are disposed in closely adjacent, spaced, parallel relationship.

8. A paperboard lid as claimed in claim 1, wherein said first, second and third weakened score lines extend to a depth of about 50% of the thickness of the paperboard lid.

9. A paperboard lid as claimed in claim 1, further comprising a fourth weakened score line extending inwardly from the corner to the second score line to form a pressure tab between the third and fourth score lines, the path of the first and fourth score lines intersecting one another at a second intersection point, one of the first and fourth score lines being a discontinuous score line and the other being a continuous score line, the discontinuous score line being interrupted closely adjacent the second intersection point such that the first and fourth score lines do not overlap at the second intersection point.

10. A paperboard lid as claimed in claim 5, wherein the first score line is the discontinuous score line and the third and fourth score lines are continuous score lines.

11. In a paperboard container of the type which comprises a tray which has upstanding side walls and a lid attached to flanges which project laterally outwardly from the upper edge, the lid having a marginal edge portion arranged to overlie the flange and to be attached thereto to close the container, the lid having an inner face and an outer face and side edges which meet at a corner of the container remote from the side wall to which the lid is attached, the improvement of;

(a) first and second weakened score lines formed in said upper and lower faces of said lid respectively, and extending obliquely across the lid at said corner to form a frangible corner panel, said first score line being located between the corner and the second score line, (b) a third weakened score line extending inwardly from the corner to the second score line, (c) the path of the first and third score lines intersecting one another at a first intersection point, one of the first and second score lines being a discontinuous score line and the other being a continuous score line, the discontinuous score line being interrupted closely adjacent the first intersection point such that the first and third score lines do not overlap at the first intersection point, (d) said corner panel being severable from the remainder of the lid by depressing the corner panel to cause it to buckle inwardly upon itself along the third score line and simultaneously causing it to tear between the first and second score lines to form an opening between the corner panel and the remainder of the lid.

12. A paperboard container as claimed in claim 11, wherein the second score line extends beyond either end of the obliquely extending portion thereof along an inner side of the marginal edge portion so as to facilitate the tearing of the lid along the second tear line to open the lid to provide access to the tray.

13. A paperboard container as claimed in claim 11, wherein the first score line is the discontinuous score line and the third score line is a continuous score line.

14. A paperboard container as claimed in claim 13, wherein the lower face of the lid is coated with a layer of ovenable plastics material, said second and third score lines being continuous and meeting one another such that the layer of plastics material is completely severed along the second and third score lines and the point at which the third score line meets the second score line such that the layer of plastic material does not offer any appreciable resistance to the tearing of the lid along the second and third score lines as the cover panel is depressed.

15. A paperboard container as claimed in claim 14, wherein said weakened score lines do not extend through the paperboard lid.

16. A paperboard container as claimed in claim 14, wherein the first and second weakened score lines are disposed in closely adjacent, spaced, parallel relationship.

17. A paperboard container as claimed in claim 12, wherein said first, second and third weakened score lines extend to a depth of about 50% of the thickness of the paperboard lid.

18. A paperboard container as claimed in claim 13, wherein the lid is hingedly attached to one of the side walls of the container.

19. A paperboard container as claimed in claim 11, wherein the first and second score lines converge toward a rupture starting point at which the spacing between the first and second score lines is such that the lid can be easily punctured by applying pressure to the starting point.

20. A paperboard container as claimed in claim 11, wherein the first score line has portions of its length arranged one on either side of the intersection point which converge toward one another and toward the intersection point so as to be located in close proximity to the second score line at the intersection point.

21. A paperboard container as claimed in claim 11, further comprising a fourth weakened score line extending inwardly from the corner to the second score line to form a pressure tab between the third and fourth score lines, the path of the first and fourth score lines intersecting one another at a second intersection point, one of the first and fourth score lines being a discontinuous score line and the other being a continuous score line, the discontinuous score line being interrupted closely adjacent the second intersection point such that the first and fourth score lines do not overlap at the second intersection point.

22. A paperboard container as claimed in claim 21, wherein the first score line is the discontinuous score line and the third and fourth score lines are continuous score lines.

* * * * *